US005465885A

United States Patent [19]

Wyatt

[11] Patent Number: 5,465,885

[45] Date of Patent: Nov. 14, 1995

[54] INSULATED BACKPACK WITH DRINKING LIQUID CONTAINER

[76] Inventor: William R. Wyatt, 14230 E. Oro Escondido, Tucson, Ariz. 85747

[21] Appl. No.: 231,929

[22] Filed: Apr. 25, 1994

[51] Int. Cl.[6] ..... A45F 3/04

[52] U.S. Cl. ..... 224/148; 224/209; 222/175

[58] Field of Search ..... 224/148, 202, 224/209, 257, 258; 222/175

[56] References Cited

U.S. PATENT DOCUMENTS

| | | | |
|---|---|---|---|
| 1,031,821 | 7/1912 | Schwarzenbach | 224/209 |
| 2,013,358 | 9/1935 | Osborne | 224/148 |
| 4,629,098 | 12/1986 | Eger | 222/175 |
| 4,921,143 | 5/1990 | Billet | 222/175 |
| 4,941,603 | 7/1990 | Creamer et al. | 224/148 |
| 4,948,023 | 8/1990 | Tripp | 224/148 |
| 4,969,587 | 11/1990 | Miller | 224/148 |
| 5,282,557 | 2/1994 | McCook | 224/148 |

*Primary Examiner*—J. Casimer Jacyna

[57] ABSTRACT

Disclosed is a combination insulated backpack and drinking liquid container whereby a user may drink fluid through a drinking tube while carrying the backpack. The insulated backpack with drinking liquid container comprises a thermally insulated backpack having a separate interior compartment. A thermally insulated top closure flap for selectively gaining access to the interior compartment of the backpack body has a zipper securement. The top closure flap also has an aperture therethrough which opens into the separate compartment. A fluid container for holding drinking liquid is removedly disposed within the separate compartment such that the neck and threaded mouth of the container align with the aperture of the top closure flap. A drinking tube assembly, having control means for enabling and disabling the flow of fluid therethrough, extends from inside the hollow container at the distal end thereof to a point in space near a user's mouth at the proximal end thereof when the backpack is mounted on the user's back. A securement clip is attached to the drinking tube assembly whereby the assembly may be clippedly removedly connected to the user's clothing to secure the proximal end of the drinking tube assembly near the user's mouth.

6 Claims, 4 Drawing Sheets

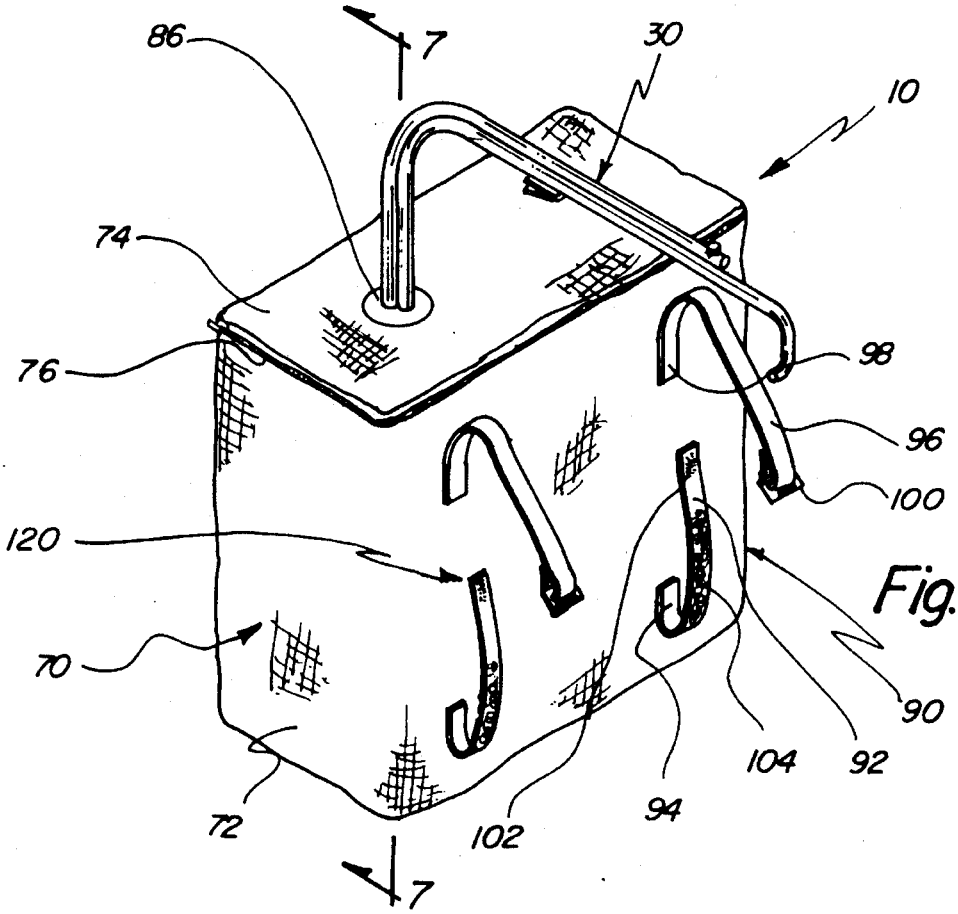
Fig. 1
Fig. 2
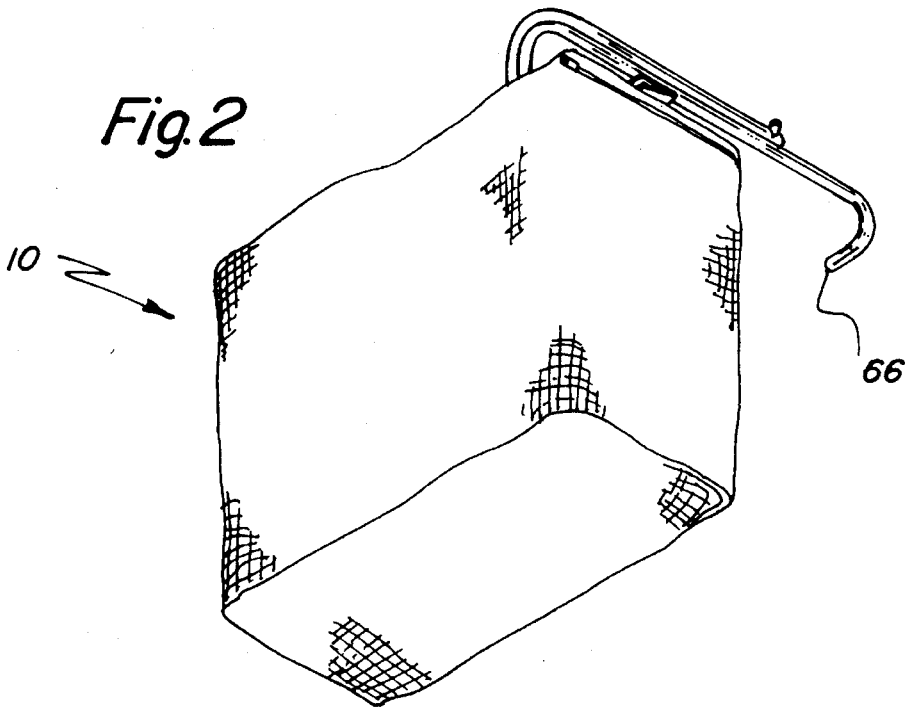

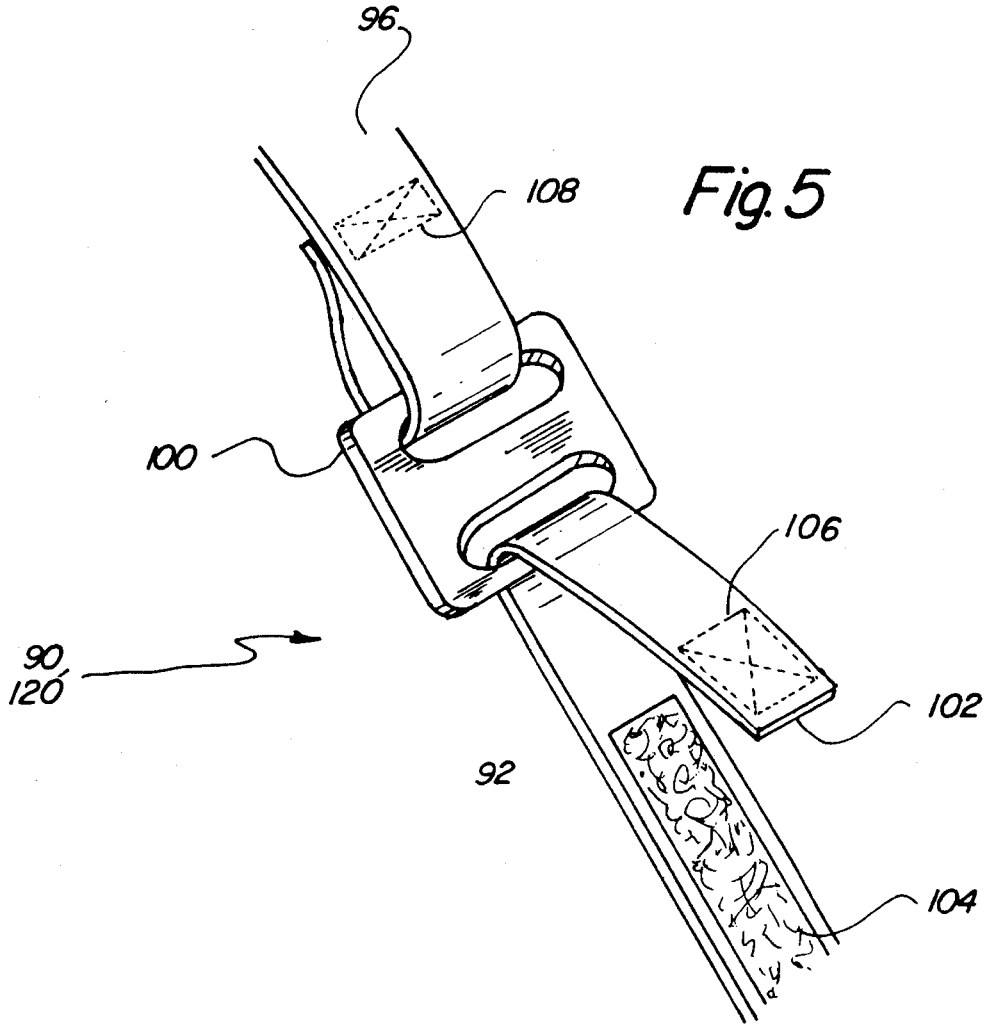
Fig. 5
Fig. 6
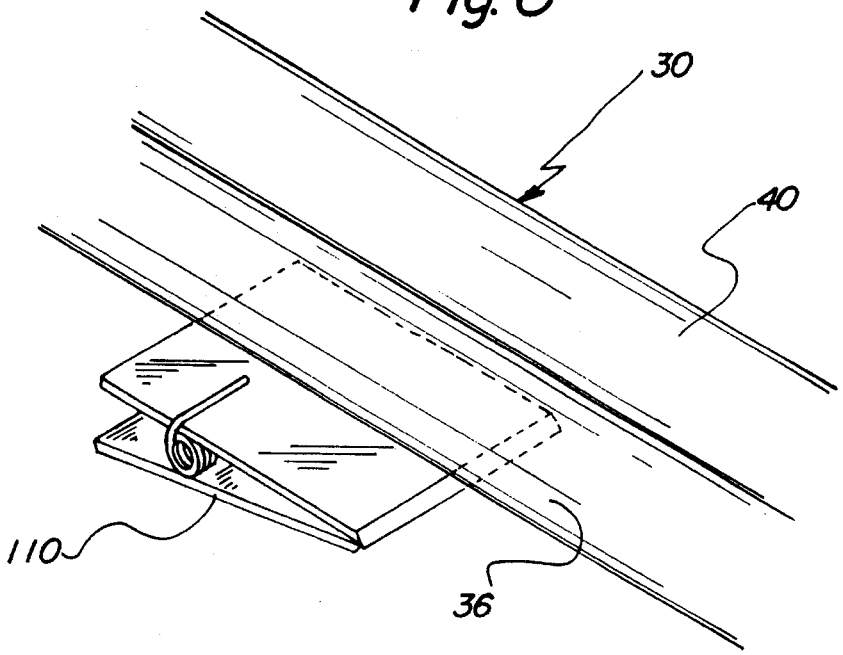

INSULATED BACKPACK WITH DRINKING LIQUID CONTAINER

BACKGROUND OF THE INVENTION

1. Field of the Invention

The present invention relates to backpack devices and more particularly pertains to an insulated backpack with drinking liquid container which may be adapted for providing a transportable drinking fluid container carryable within an insulated backpack whereby the user may drink the fluid through a drinking tube while carrying the backpack.

2. Description of the Prior Art

The use of backpack devices is known in the prior art. More specifically, backpack devices heretofore devised and utilized for the purpose of transporting items are known to consist basically of familiar, expected and obvious structural configurations, notwithstanding the myriad of designs encompassed by the crowded prior art which have been developed for the fulfillment of countless objectives and requirements.

The present invention is directed to improving devices for transporting items with a backpack in a manner which is safe, secure, economical and aesthetically pleasing.

The prior art discloses the following related patents: U.S. Pat. No. 4,706,856 to Jacober, U.S. Pat. No. 5,150,837 to Ferrari, U.S. Pat. No. 4,561,578 to Bell, U.S. Pat. D. No. 284,620 to Calton, and U.S. Pat. D. No. 284,715 to Jacober et al.

While these devices fulfill their respective, particular objectives and requirements, the aforementioned patents do not disclose a insulated backpack with drinking liquid container for providing a transportable drinking fluid container carryable within an insulated backpack whereby the user may drink the fluid through a drinking tube while carrying the backpack.

In this respect, the insulated backpack with drinking liquid container according to the present invention substantially departs from the conventional concepts and designs of the prior art, and in so doing provides an apparatus primarily developed for the purpose of providing a transportable drinking fluid container carryable within an insulated backpack whereby the user may drink the fluid through a drinking tube while carrying the backpack.

Therefore, it can be appreciated that there exists a continuing need for a new insulated backpack with drinking liquid container which can be used for providing a transportable drinking fluid container carryable within an insulated backpack whereby the user may drink the fluid through a drinking tube while carrying the backpack. In this regard, the present invention substantially fulfills this need.

As illustrated by the background art, efforts are continuously being made in an attempt to develop devices for transporting items with a backpack. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of backpack devices now present in the prior art, the present invention provides a new backpack devices construction wherein the same can be utilized for providing a transportable drinking fluid container carryable within an insulated backpack whereby the user may drink the fluid through a drinking tube while carrying the backpack. As such, the general purpose of the present invention, which will be described subsequently in greater detail, is to provide a new insulated backpack with drinking liquid container apparatus and method which has all the advantages of the prior art backpack devices and none of the disadvantages.

The invention is defined by the appended claims with the specific embodiment shown in the attached drawings. For the purpose of summarizing the invention, the invention may be incorporated into a combination insulated backpack and drinking liquid container whereby a user may drink fluid through a drinking tube while carrying the backpack. The insulated backpack with drinking liquid container comprises a thermally insulated backpack comprising a plurality of thermally insulated fabric panels that are joined together to form a soft-walled thermally insulated backpack body defining a backpack interior compartment that is sized and shaped to be suitable for storing and carrying goods and gear. The backpack interior compartment has a thermally insulated fabric divider panel therein defining a separate interior chamber. The backpack body has a backstrap for attaching the backpack to a user's back. A thermally insulated fabric top closure flap has securement means for selectively gaining access to the interior compartment of the backpack body. The top closure flap also has an aperture therethrough opening into the separate chamber of the interior compartment.

A fluid container for holding drinking liquid comprises a resilient hollow plastic container body having an upwardly extending hollow neck communicating with a threaded mouth. The container is removedly disposed within the separate chamber of the backpack interior compartment such that the neck and threaded mouth align with the aperture of the top closure flap.

A drinking tube assembly extends from inside the hollow container at the distal end thereof to a point in space near a user's mouth at the proximal end thereof when the backpack is mounted on the user's back. The drinking tube assembly comprises a liquid-tight closure cap threadedly engaged with the threaded mouth of the fluid container such that the top of the cap extends through the aperture of the top closure flap, the cap having an aperture through the top thereof. A first elongated resilient tube extends through the aperture, the distal end being positioned near the bottom of the fluid container wherethrough drinking fluid may enter the tube. The proximal end of the first tube is shaped for comfortable mouth engagement by the user's lips and teeth while drinking. A second elongated resilient tube extends through the aperture, the second tube being collaterally connected to the first tube. The distal end of the second tube is positioned near the top of the fluid container, above the normal liquid level, whereby air may enter the container to equalize atmospheric pressure within the container to allow liquid to be withdrawn from the container. The proximal end of the second tube has valve means positioned near the proximal end of the first tube for easy access by the user. The valve means has first and second control positions whereby the first control position prevents pressure equalizing air from entering the container for preventing drinking fluid from flowing through the first tube and the second control position allows pressure equalizing air to enter the container for allowing drinking fluid to flow through the first tube. An O-ring seal around the perimeter of the aperture through the cap prevents fluid leakage around the first and second tubes. Securement clip means is attached to the first and second tubes, intermediate the cap and the proximal end thereof, whereby the tubes may be clippedly removedly connected to the users clothing to secure the proximal end of the drinking tube assembly near the user's mouth.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an insulated backpack with drinking liquid container for providing a transportable drinking fluid container carryable within an insulated backpack whereby the user may drink the fluid through a drinking tube while carrying the backpack.

It is another object of the present invention to provide a new insulated backpack with drinking liquid container which may be easily and efficiently manufactured and marketed.

It is a further object of the present invention to provide a new insulated backpack with drinking liquid container which is of a durable and reliable construction.

An even further object of the present invention is to provide a new insulated backpack with drinking liquid container which is susceptible of a low cost of manufacture with regard to both materials and labor, and which accordingly is then susceptible of low prices of sale to the consuming public, thereby making such insulated backpack with drinking liquid containers economically available to the buying public.

Still yet another object of the present invention is to provide a new insulated backpack with drinking liquid container which provides in the apparatuses and methods of the prior art some of the advantages thereof, while simultaneously overcoming some of the disadvantages normally associated therewith.

Still yet another object of the present invention is to provide a insulated backpack with drinking liquid container for use by hikers, bikers, hunters, Scouts, families with small children, and the like who always want/need liquids with as little inconvenience as possible.

Yet another object of the present invention is to provide a insulated backpack with drinking liquid container that will maintain the temperature of hot and cold liquids for extended periods of time.

Even still another object of the present invention is to provide a insulated backpack with drinking liquid container that enables users to drink without ceasing their current activity or removing the container from the backpack.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the insulated backpack with drinking liquid container showing the top, front, and right side of the invention.

FIG. 2 is a perspective view of the insulated backpack with drinking liquid container showing the bottom, back, and right side of the invention.

FIG. 5 is a perspective detail view of the backstrap adjustment means.

FIG. 6 is a perspective detail view of the drinking tube assembly securement clip.

DESCRIPTION OF THE PREFERRED EMBODIMENT

Figure 3:
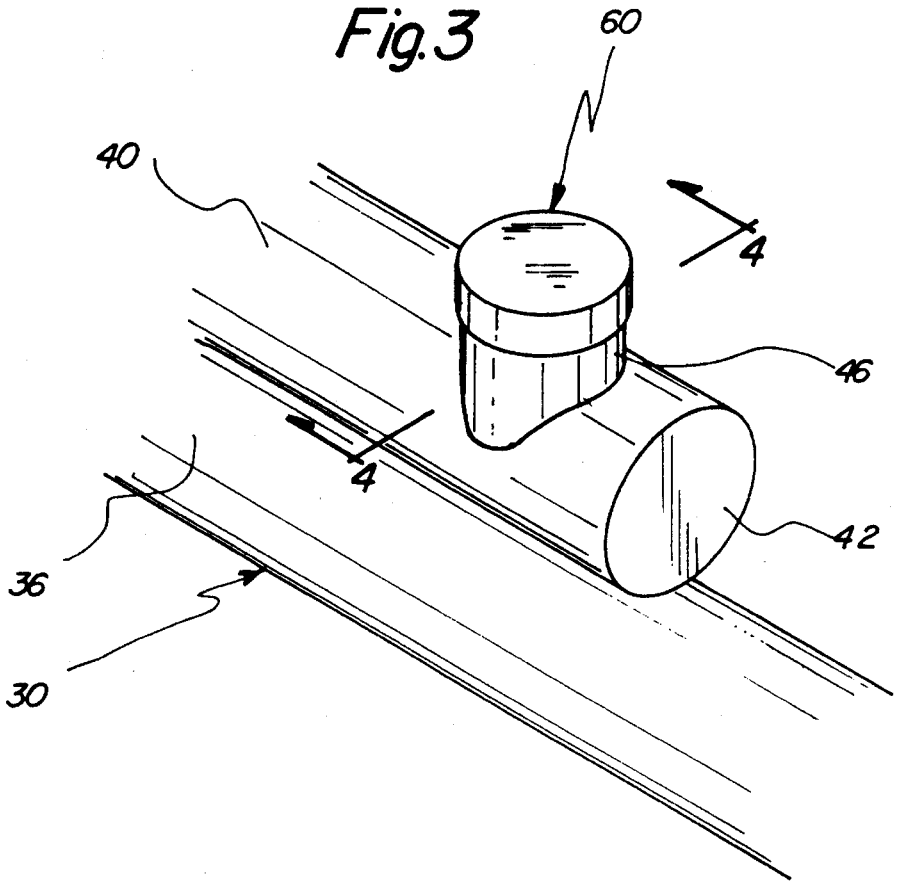
FIG. 3 is a perspective detail view of the liquid flow enabling/disabling valve.

With reference now to the drawings, and in particular to FIG. 1 thereof, a insulated backpack with drinking liquid container embodying the principles and concepts of the present invention and generally designated by the reference numeral 10 will be described.

From an overview standpoint, the insulated backpack with drinking liquid container is adapted for use for providing a transportable drinking fluid container carryable within an insulated backpack whereby the user may drink the fluid through a drinking tube while carrying the backpack. See FIG. 1.

Figure 4:
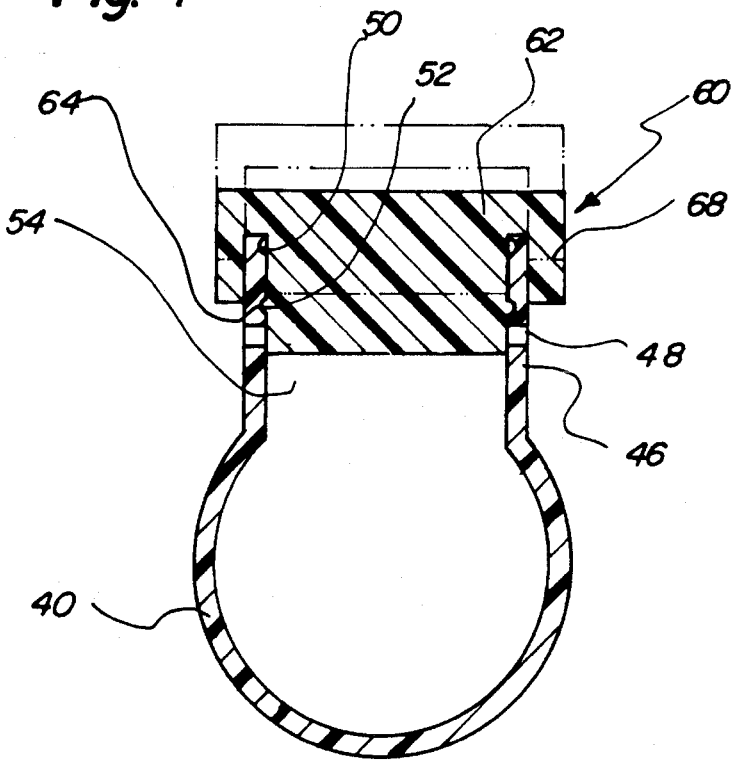
FIG. 4 is a sectional view of the invention of FIG. 3 taken along the line 4—4.
Figure 7:
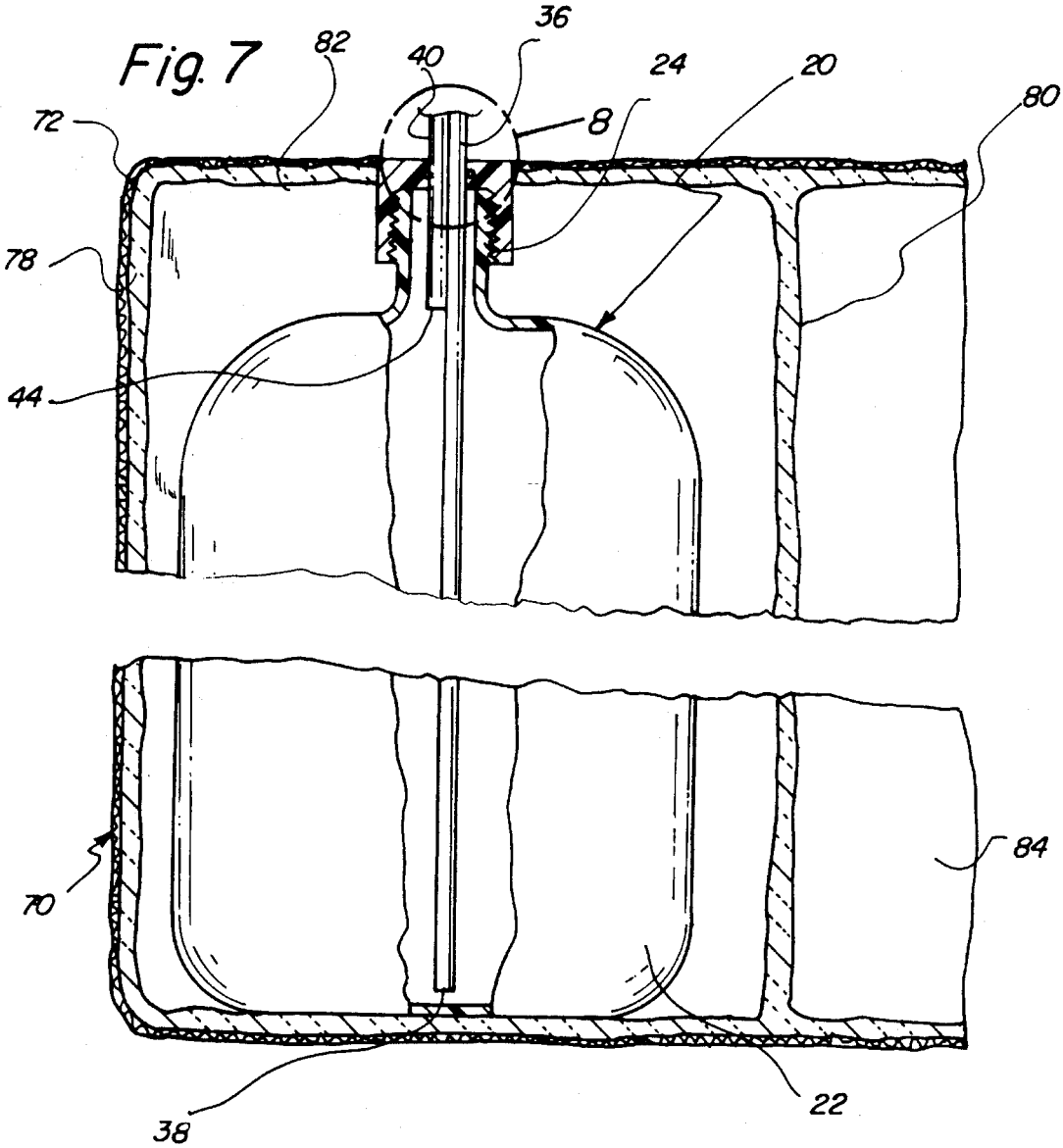
FIG. 7 is a sectional view of the invention of FIG. 1 taken along the line 7—7.
Figure 8:
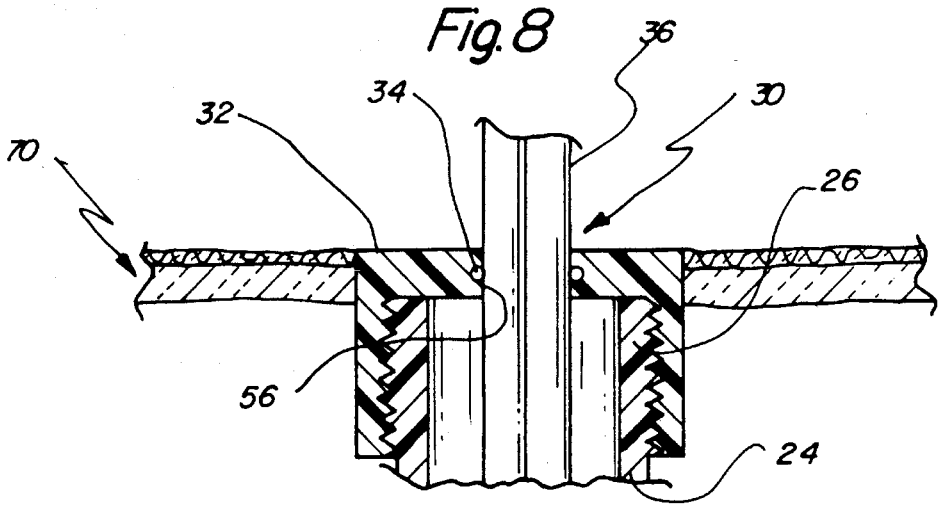
FIG. 8 is a detail view of the O-ring seal of the drinking tube assembly.

With reference now to FIGS. 1–8 and more specifically, it will be noted that an insulated backpack with drinking liquid container 10 is shown. The insulated backpack with drinking liquid container 10 comprises a thermally insulated backpack 70 comprising a plurality of thermally insulated fabric panels 72 that are joined together to form a soft-walled thermally insulated backpack body defining a backpack interior compartment 84 that is sized and shaped to be suitable for storing and carrying goods and gear. The backpack interior compartment 84 has a thermally insulated fabric divider panel 80 therein defining a separate interior chamber 82. The backpack body has a backstrap 100 and 120 for attaching the backpack to a user's back, the backstrap comprising an identical pair of vertically oriented horizontally spaced apart elongated adjustable flexible straps 90 and 120 for extending over the shoulders and under the arms of the user whereby supporting the weight of the backpack 70 on the user's shoulders.

Each strap 90 and 120 comprises an upper portion 96 fixedly connected at it's upper end 98 to the front of the backpack 70 near the top of the pack body. The upper portion 96 has a buckle 100 fixedly connected to the free end thereof by a plurality of threads or stitches 108. The strap 90 or 120 also has a lower portion 92 fixedly connected at it's lower end 94 to the front of the backpack 70 near the bottom of the pack body. Adjustable securement means, comprising a two part interengageable fabric hook and loop closure 102 and 104, is disposed on the lower strap portion 92 with the hook part 102 being fixedly connected proximal the free end of the strap with a plurality of threads or stitches 106 and the loop part 104 being fixedly connected intermediate the hook part 102 and the lower end 94 thereof.

In use, the free end of the lower strap portion 92 is pulled through the buckle 100 to form a closed loop with the upper strap portion 96 for encircling the user's shoulders. The free end of the lower strap portion 92 having the hook fabric part 102 is folded back against the loop fabric part 104 whereby the size of the loop may be adjustably set to comfortably fit the user. A thermally insulated fabric top closure flap 74 has a securement zipper 76 for selectively gaining access to the interior compartment 84 of the backpack body. The top closure flap 74 also has an aperture 86 therethrough opening into the separate chamber 82 of the interior compartment 84.

A fluid container 20 for holding drinking liquid comprises a resilient hollow plastic container body 22 having an upwardly extending hollow neck 24 communicating with a threaded mouth 26. The container 20 is removedly disposed within the separate chamber 82 of the backpack interior compartment 84 such that the neck 24 and threaded mouth 26 align with the aperture 86 of the top closure flap 74.

A drinking tube assembly 30 extends from inside the hollow container 20 at the distal end thereof to a point in space near a user's mouth at the proximal end thereof when the backpack 10 is mounted on the user's back. The drinking tube assembly 30 comprises a liquid-tight closure cap 32 threadedly engaged with the threaded mouth 26 of the fluid container 20 such that the top of the cap 32 extends through the aperture 86 of the top closure flap 74. The cap 32 has an aperture 56 through the top thereof. A first elongated resilient tube 36 extends through the aperture 56, the distal end 38 being positioned near the bottom of the fluid container 20 wherethrough drinking fluid may enter the tube 36. The proximal end 66 of the first tube 36 is shaped for comfortable mouth engagement by the user's lips and teeth while drinking.

A second elongated resilient tube 40 also extends through the aperture 56, the second tube 40 being collaterally connected to the first tube 36. The distal end 44 of the second tube 40 is positioned near the top of the fluid container 20, above the normal liquid level, whereby air may enter the container to equalize atmospheric pressure within the container 20 to allow liquid to be withdrawn therefrom. The proximal end 42 of the second tube 40 has valve means 60 positioned near the proximal end 66 of the first tube 36 for easy access by the user. The valve means 60 has first and second control positions whereby the first control position prevents pressure equalizing air from entering the container 20 for preventing drinking fluid from flowing through the first tube 36 and the second control position allows pressure equalizing air to enter the container 20 for allowing drinking fluid to flow through the first tube 36. The valve means 60 comprises an upwardly extending tubular valve body 46 having an open end 54. The valve body 46 also has a plurality of annularly spaced apart apertures 48 therethrough proximal the open end 54 thereof wherethrough air may enter the valve means 60. The valve body 46 further has a pair of spaced apart internal annular grooves 50 and 52 formed therein intermediate the open end 54 and the plurality of apertures 48.

A cylindrical valve control element 62, having an exposed finger grip portion 68, is seated within the valve body 46 such, in it's downwardmost first position the apertures 48 are obstructed to prevent air from flowing into the second tube 36 and, in it's upwardmost second position the apertures 48 are exposed to allow air to flow into the second tube 36. The valve control element 62 further has an annular ring formed therearound for engagement with the annular grooves 50 and 52 of the valve body 46 whereby providing a detent action to define the first and second control positions. An O-ring seal 34 around the perimeter of the aperture 56 through the cap 32 prevents fluid leakage around the first and second tubes 36 and 40.

A securement clip 110 is attached to the drinking tube assembly 30, intermediate the cap 32 and the proximal end thereof, whereby the tube assembly 30 may be clippedly removedly connected to the users clothing to secure the proximal end thereof near the user's mouth.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A combination insulated backpack and drinking liquid container whereby a user may drink fluid through a drinking tube while carrying the backpack, the insulated backpack with drinking liquid container comprising:

a thermally insulated backpack comprising a plurality of thermally insulated fabric panels that are joined together to form a soft-walled thermally insulated backpack body defining a backpack interior compartment that is sized and shaped to be suitable for storing and carrying goods and gear, the backpack interior compartment having a thermally insulated fabric divider panel therein defining a separate interior chamber, the backpack body having a backstrap, an interior surface and an exterior surface, a thermally insulated fabric top closure flap with securement means for selectively gaining access to the interior compartment of the backpack body, the top closure flap having an aperture therethrough opening into the separate chamber of the interior compartment;

a fluid container for holding drinking liquid comprising a resilient hollow plastic container body having an upwardly extending hollow neck communicating with a threaded mouth, the container being removedly disposed within the separate chamber of the backpack interior compartment such that the neck and threaded mouth align with the aperture of the top closure flap; and a drinking tube assembly extending from inside the hollow container at the distal end thereof to a point in space near a user's mouth at the proximal end thereof when the backpack is mounted on the user's back, the drinking tube assembly comprising: a liquid-tight closure cap threadedly engaged with the threaded mouth of the fluid container such that the top of the cap extends through the aperture of the top closure flap, the cap having an aperture through the top thereof; a first elongated resilient tube extending through the aperture, the distal end of the first tube being positioned near the bottom of the fluid container wherethrough drinking fluid may enter the tube, the proximal end of the first tube being shaped for comfortable mouth engagement by the user's lips and teeth while drinking; a second elongated resilient tube extending through the aperture, the second tube being collaterally connected to the first tube, the distal end of the second tube being positioned near the top of the fluid container above the normal liquid level whereby air may enter the container to equalize atmospheric pressure within the container to allow liquid to be withdrawn from the container, the proximal end of the second tube having valve means positioned near the proximal end of the first tube for easy access by the user, the valve means having first and second control positions whereby the first control position prevents pressure equalizing air from entering the container for preventing drinking fluid from flowing through the first tube and the second control position allows pressure equalizing air to enter the container for allowing drinking fluid to flow through the first tube; an O-ring seal around the perimeter of the aperture through the cap for preventing fluid leakage around the first and second tubes; securement clip means attached to the first and second tubes intermediate the cap and the proximal end thereof whereby the tubes may be clippedly removedly connected to the users clothing to secure the proximal end of the drinking tube assembly near the user's mouth.

2. A combination insulated backpack and drinking liquid container whereby a user may drink fluid through a drinking tube while carrying the backpack, the insulated backpack with drinking liquid container comprising:

a thermally insulated backpack having at least two interior compartments therein, the thermally insulated backpack comprising plurality of thermally insulated fabric panels that are joined together to form a soft-walled thermally insulated backpack body, the backpack body having a backstrap, an interior surface and an exterior surface, a thermally insulated fabric top closure flap with securement means formed as a zipper for gaining access to the interior compartments of the backpack body, the top closure flap having an aperture therethrough opening into one of the at least two interior compartments, the backstrap further comprising a pair of vertically oriented horizontally spaced apart elongated adjustable flexible straps for extending over the shoulders and under the arms of the user thereby supporting the weight of the backpack on the user's shoulders;

a fluid container for holding drinking liquid removedly disposed within one of the at least two interior compartments;

the fluid container comprising a resilient hollow plastic container body having an upwardly extending hollow neck communicating with a threaded mouth, the container being removedly disposed within the compartment adjacent the aperture through the closure flap such that the neck and threaded mouth align with the aperture; and a drinking tube assembly extending from inside the fluid container at the distal end thereof to a point in space near a user's mouth at the proximal end thereof when the backpack is mounted on the user's back, the drinking tube assembly having control means for enabling and disabling the flow of fluid through the tube assembly.

3. The insulated backpack with drinking liquid container of claim 2 wherein, the drinking tube assembly comprises: a liquid-tight closure cap threadedly engaged with the threaded mouth of the fluid container such that the top of the cap extends through the aperture of the top closure flap, the cap having an aperture through the top thereof; a first elongated resilient tube extending through the aperture, the distal end of the first tube being positioned near the bottom of the fluid container wherethrough drinking fluid may enter the tube, the proximal end of the first tube being shaped for comfortable mouth engagement by the user's lips and teeth while drinking.

4. The insulated backpack with drinking liquid container of claim 3 wherein the control means comprises a second elongated resilient tube extending through the aperture of the cap, the second tube being collaterally connected to the first tube, the distal end of the second tube being positioned near the top of the fluid container above the normal liquid level whereby air may enter the container to equalize atmospheric pressure within the container to allow liquid to be withdrawn from the container, the proximal end of the second tube having valve means positioned near the proximal end of the first tube for easy access by the user, the valve means having first and second control positions whereby the first control position prevents pressure equalizing air from entering the container for disabling drinking fluid from flowing through the first tube and the second control position allows pressure equalizing air to enter the container for enabling drinking fluid to flow through the first tube.

5. The insulated backpack with drinking liquid container of claim 4 and further including an O-ring seal around the perimeter of the aperture through the cap for preventing fluid leakage around the first and second tubes.

6. The insulated backpack with drinking liquid container of claim 5 wherein the drinking tube assembly further includes securement clip means attached to the first and second tubes intermediate the cap and the proximal end thereof whereby the tubes may be clippedly removedly connected to the users clothing to secure the proximal end of the drinking tube assembly near the user's mouth.

* * * * *